United States Patent [19]

Masselin et al.

[11] 4,322,067

[45] Mar. 30, 1982

[54] ARTICLE TRANSFER APPARATUS

[75] Inventors: Paul H. Masselin, Richmond; Karl H. Wieland, Mechanicsville, both of Va.

[73] Assignee: Philip Morris Incorporated, New York, N.Y.

[21] Appl. No.: 968,363

[22] Filed: Dec. 11, 1978

[51] Int. Cl.[3] ..... B65H 3/08

[52] U.S. Cl. ..... 271/99; 221/211; 294/64 R; 414/121

[58] Field of Search ..... 221/211; 414/72, 121, 414/128, 330; 294/64 R, 65; 271/99, 102, 12, 99

[56] References Cited

U.S. PATENT DOCUMENTS

| | | | |
|---|---|---|---|
| 1,141,412 | 6/1915 | Pool | 414/330 X |
| 2,734,674 | 2/1956 | Ray | 221/211 X |
| 2,828,596 | 4/1958 | Dowty et al. | 221/211 X |
| 2,920,916 | 1/1960 | Pagdin | 414/121 X |
| 3,195,941 | 7/1965 | Morey | 294/64 R |
| 3,606,960 | 9/1971 | Butterworth | 221/211 |
| 3,797,822 | 3/1974 | Anderson | 271/99 X |
| 4,168,772 | 9/1979 | Eberle | 221/211 X |

FOREIGN PATENT DOCUMENTS

| | | | |
|---|---|---|---|
| 2227835 | 1/1973 | Fed. Rep. of Germany | 221/211 |
| 1210491 | 10/1970 | United Kingdom | 221/221 |

*Primary Examiner*—Steven A. Bratlie

*Attorney, Agent, or Firm*—Watson, Leavenworth, Kelton & Taggart

[57] ABSTRACT

Apparatus for transferring articles between a storage location and a point of use location in which a carrier arm fitted with suction cups is rotated and elevated from one position to bring its suction cups into engagement with the lowermost article in a stack of such, the carrier arm thereafter being counter-rotated and lowered to bring the article to an article release position. Carrier arm movement is effected by a slidable actuator member and a cooperating pair of air cylinder units, a pinion gear and rack arrangement being employed to effect carrier arm rotative movement.

9 Claims, 4 Drawing Figures

FIG. 2
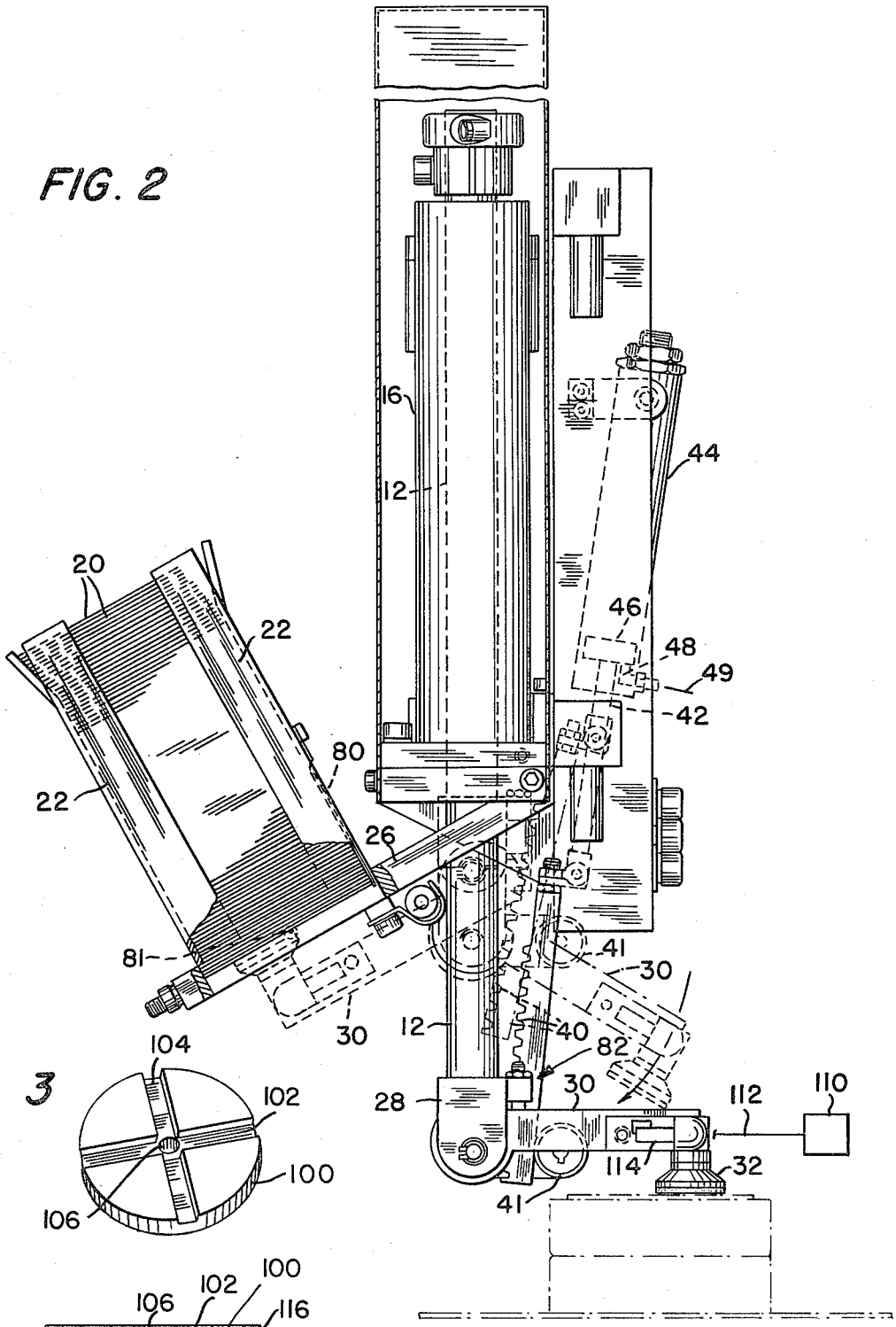
FIG. 3
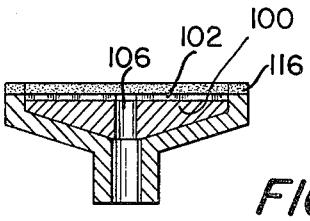
FIG. 4

ARTICLE TRANSFER APPARATUS

BACKGROUND OF THE INVENTION

The present invention relates to apparatus for transferring articles between two points as, for example, from a magazine containing a stock of such articles to a point of use remote from the magazine. Pertinent to the apparatus of the invention are U.S. Pat. Nos. 956,473; 1,315,737; 1,435,334; 3,158,381; 3,191,746; 3,513,989; 3,776,393; 3,836,017; 4,042,126; and 4,081,945.

SUMMARY OF THE PRESENT INVENTION

The present invention relates to apparatus for transferring articles in single-wise manner from a storage location for such articles to a second location or point of use for such articles. The apparatus is described herein in terms of its applicability for removing a coupon or card from a stock of such and transfer delivery of same to the top of an aligned row of five pairs of cigarette packages as a prior adjunct of erecting a carton enclosure around such cigarette packages. While the particular embodiment thus described is employed for a particular purpose in the cigarette-manufacturing operation, it will be appreciated that the invention has broader embrace and the apparatus could be employed for transferring articles of a wide range of description from one location to another for any one of a number of purposes.

In accordance with the present invention, the apparatus includes a magazine for holding a superposed stack of a plurality of the articles which can be flat cards, coupons, or the like, the magazine being designed such that the articles are withdrawn from a bottom opening therein. Disposed adjacent the magazine is an upright housing in which is received and guided for sliding movement along a fixed vertical axis, an actuator member to the lower end of which a carrier arm is rotatably mounted. Disposed adjacent the housing is a double acting cylinder unit provided with a piston and rod connected at one end to the piston with the other or upper end of the cylinder rod being connected to the upper end of the actuator member by a laterally disposed connector piece. Also disposed adjacent the housing is a second single acting cylinder unit in which the piston thereof is connected to one end of a cylinder rod, with the other end being connected to a rack. A pinion gear is carried at the lower end of the actuator member and is fixed to the carrier arm with the pinion gear being in constant mesh with the rack. The arrangement of the apparatus is such that the magazine is located at one side of the fixed vertical axis along which the actuator member moves, and the point of use to which an article withdrawn from the magazine is delivered is disposed at the other side of said axis and at an elevation below that of the magazine.

During the operation of the apparatus, the actuator member moves between first and second positions and vice versa. When the actuator member is moved from its first to second position by upward stroking of the piston and rod in the double acting cylinder unit, the carrier arm is vertically elevated and concurrently rotated in one direction away from a positioning thereof at the point of use at one side of the fixed axis, as for example, the location in a cigarette-making operation at which the aligned five pairs of cigarette packages are packed in a carton structure, to position same at the other side of the fixed axis and adjacent the magazine, the resulting carrier arm positioning being such that suction imposing means carried on the carrier arm are engaged against the lowermost article in the stack. The suction applied by the imposing means causes same to grab and hold the lowermost article in the stack so that when the actuator member is moved from its second to first position, the suction imposing means will move away from the magazine and withdraw such lowermost article from the magazine. During movement of the actuator member from its second to first position, the carrier arm will concurrently be rotated in an opposite direction and vertically lowered to return the carrier arm to the point of use position with the said lowermost article being delivered on top of the five pairs of cigarette packages upon release of the suction which had been imposed on the article.

The movement of the carrier arm in being elevated, rotated, then counter-rotated and lowered during each article transfer cycle is effected by means of the engagement of the pinion gear with the rack and the operation of the two cylinder units. As the actuator member moves upwardly from its first to second positions, the single acting air cylinder which is maintained under constant condition of pressure functions as a bias means associated with the rack to move the rack generally codirectionally with the movement of the actuator member during an initial portion of the movement of the actuator member between its first and second positions so that there is concurrent generally codirectional movement of the actuator member and the rack. However, after the piston in the single acting cylinder is stroked upwardly its maximum travel distance, said cylinder unit operates as a bias limiting means during the remainder movement of the actuator member between its first and second positions for preventing further upward travel of the rack. As a consequence, the pinion gear fixed to the carrier arm and in constant mesh with the rack, is caused to rotate resulting in rotation of the carrier arm in one direction to move it from the point of use side of the vertical axis to the side at which the magazine is located, the remainder portion movement of the actuator member between its first and second positions elevating the carrier arm to bring the suction imposing means (desirably provided in the form of suction cups) into engagement with the lowermost article in the stack thereof contained in the magazine. When the double acting cylinder is operated to return the actuator member downwardly from its second to first positions, the actuator member will, during an initial portion of the downward movement thereof, be working against the bias means of the single acting cylinder unit so that the rack will not move downwardly so that the pinion gear will be caused to rotate to cause in turn rotation of the carrier arm in an opposite direction to bring it to the point of use side of the fixed axis. However, during the remainder portion of the downward movement of the actuator member between its second and first positions, the carrier arm will be engaged against a lateral stop carried at the lower end of the actuator member which will prevent continued rotation of the carrier arm and result in the rack being caused to be moved in tandem downwardly with the actuator member and in opposition to the bias means applied by the single acting cylinder unit, the force applied by the double acting cylinder unit to the actuator member being sufficient to that purpose.

With the article holding suction imposing means now positioned above the aligned five pairs of cigarette packages, the suction imposing means can be released and the article dropped on top of the cigarette packages.

In accordance with the invention, the suction imposing means are as indicated desirably provided in the form of suction cups which include a central disc member having intersecting groove surfaces formed in the article engaging face thereof and in communication with a central passage formed in the disc and by means of which the disc can be placed in communication with a source of vacuum. Also, each suction cup is provided with a lip structure extending in an encircling course around the disc member with the material of the lip being of relatively softer character than that of the disc member. The disc member article engaging face is recessed some distance behind the end edge of the lip structure with the distance being dependent upon the rigidity of the articles being handled with the apparatus. For example, if the article is of a generally rigid character such as paperboard, a greater recessing would be employed than where the article was of softer, less-rigid character such as a sheet of paper or a coupon.

Both cylinder units are fluid, preferably air pressure components.

BRIEF DESCRIPTION OF THE DRAWINGS

A fuller understanding of the nature and objects of the present invention will be had from the following detailed description taken in conjunction with the accompanying drawings showing by way of example a preferred embodiment of the inventive concept and in which:

FIG. 2 is a right end elevational view of the apparatus shown in FIG. 1.

FIG. 3 is a perspective view depicting the disc member employed in the suction imposing means and particularly showing the intersecting grooves formed therein.

FIG. 4 is an elevational view in section of the suction cup members showing the manner in which the disc members are received therein and a lip extension is formed in an encircling course about the disc members.

Throughout the following description, like reference numerals are used to denote like parts in the drawings.

DESCRIPTION OF THE PREFERRED EMBODIMENTS

Figure 1:
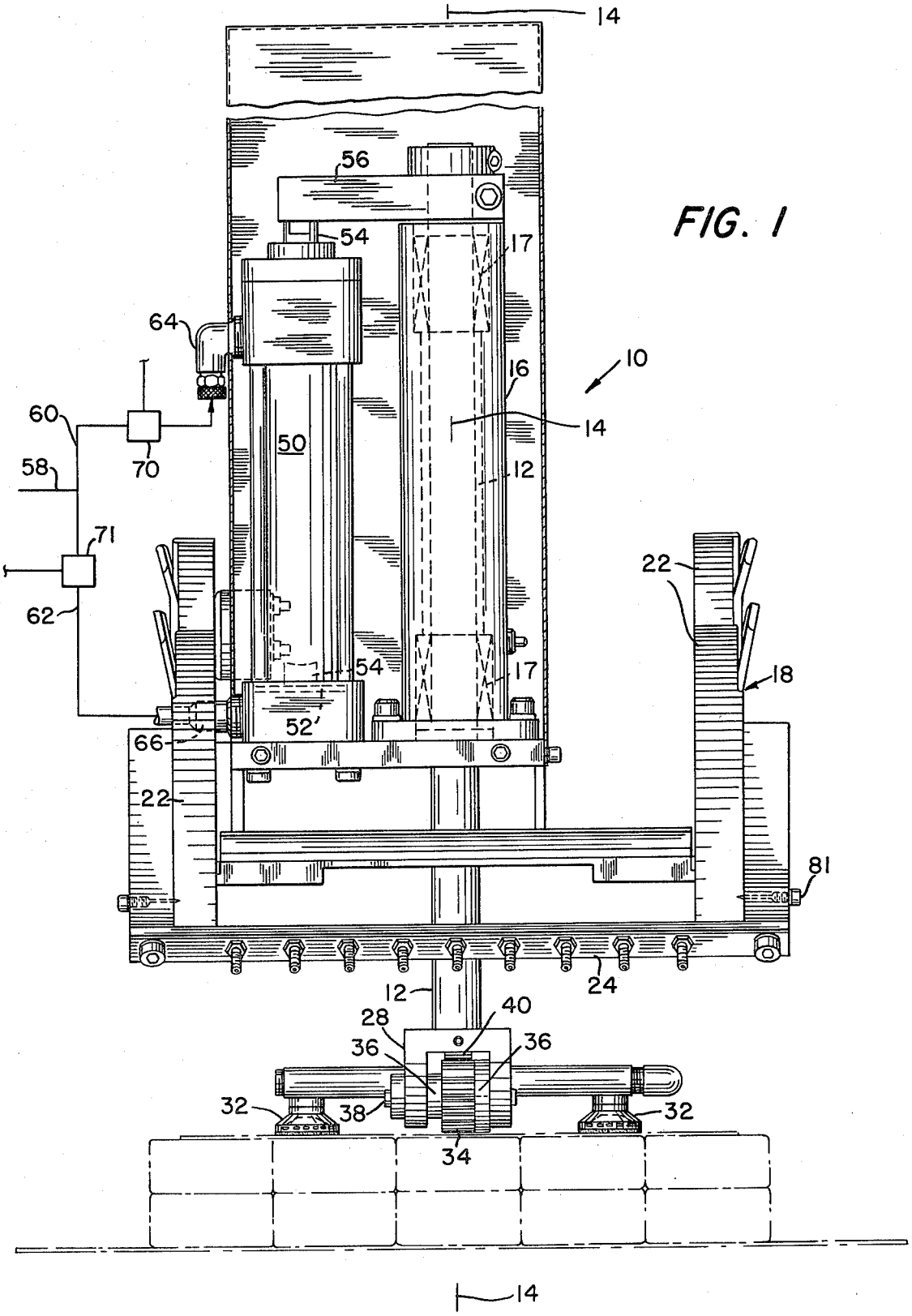
FIG. 1 is a front elevational view of article transfer apparatus constructed in accordance with the principles of the present invention.

Referring to FIGS. 1 and 2 of the drawings, the apparatus of the present invention generally depicted at 10 includes an elongated actuator member 12 which is disposed for sliding movement along a vertical axis 14 and for which purpose is received in a housing member 16 containing suitable guidance means 17 for maintaining the movement thereof in a straight line vertical course. Disposed at one side (the front side of the apparatus) is a magazine unit 18 in which is received a superposed stack of articles 20 which are to be transferred in single-wise fashion therefrom to a point of use, the point of use being at the other side or rear side of the apparatus and constituting as noted earlier a point in the cigarette-manufacturing operation where five aligned pairs of cigarette packages are enclosed in a carton, the purpose being to insert a card, premium coupon or the like in each carton. The magazine unit 18 is, it will be noted, located some distance above the location of the point of use and is comprised of a plurality of upstanding members 22 interconnected by cross-members 24 and including angularly disposed supports 26 which join the magazine to the central structure of the apparatus. Various other configurations of magazine structure can be used depending on the type of article to be transferred. Further, the magazine structure can be such as to allow adjustment thereof for reception of varying sizes of articles.

Fixed to the lower end of actuator member 12 is a clevis 28 in which is rotatably mounted a carrier arm structure 30 at the tip ends of which are mounted suction cups 32. Also fixed to the carrier arm 30 is a pinion gear 34 disposed intermediate a pair of spacer rings 36 received on pivot 38 carried in clevis 28. The pinion gear 34 is in constant mesh with a rack 40 being held in such condition by means of cam follower 41, and the rack 40 is fixed at its upper end to the rod 42 of a single acting cylinder unit 44, the piston 46 of which is shown in its retracted position, it being understood and as will be made more clear later on, the single acting cylinder functioning as a biasing means for applying a certain bias force to the rack tending to elevate same, the air pressure for actuating the cylinder being admitted through port 48 from air line 49.

As best seen in FIG. 1, a double acting cylinder unit 50 is disposed at one side of housing 16 and includes therein a piston 52 which in the FIG. 1 position of the apparatus is in retracted or lowered position, the piston rod 54 extending upwardly through the cylinder unit and being connected at its upper end by means of a laterally directed tie bar 56 to the upper end of actuator member 12.

For actuating the double acting cylinder 50, there is provided a suitable air pressure supply line 58 having branches 60 and 62, respectively, which lead to the upper and lower end ports 64, 66 of the cylinder unit, there being provided a suitable venting or pressure release means which could, e.g., be provided in the form of signal operated dump valves 70, 71 or like device for facilitating outflow of air from the side of the cylinder at the non-working piston face thereof. In other words, when the double acting cylinder piston is stroked upwardly, air under pressure is admitted through branch 62 (FIG. 1), whereas, any air above the piston is vented through port fitting 64 and by suitable orientation of the valve 70 for such purposes. On the other hand, when the piston and rod are in the upward extended position, air pressure will be supplied through branch 60 (FIG. 1) to retract the cylinder and valve 71 will be suitably oriented to vent air at the underside of the piston 52.

When it is desired to effect transfer of an article 20 from the magazine 18 to the point of use, the same is effected in the manner to be described next.

As shown in FIGS. 1 and 2, the apparatus is in a condition in which the carrier arm 30 and suction cups 32 are disposed at the point of use and at one side of vertical axis 14. Upon actuation of the double acting cylinder 50 to commence a transfer cycle, its piston 52 and rod 54 stroke upwardly, and the same will cause the actuator member 12 to rise upwardly. During an initial portion of the travel of the actuator member 12 from its first (lowered) to second (elevated) position, the biasing force applied to the rack 40 by means of cylinder unit 44 will cause a generally codirectional concurrent raising of the rack with the actuator member. However, when piston 46 reaches the end of its upward stroke in cylinder unit 44, the same will function as a bias limiting means to preclude further upward movement of the rack member. At such point and for the remainder travel of the actuator member 12 from its first to second positions, the pinion gear 34 because of its constant mesh with the rack will be caused to rotate. In rotating in a clockwise direction as viewed in FIG. 2, the carrier arm 30 will be rotated to bring it to the other side of the fixed axis and the continued upward movement of the actuator member will elevate the carrier arm so that the suction cups are now inverted, the carrier arm having moved from the position shown in full lines to the position shown in dashed lines, and in which position the suction cups engage the lowermost article in the stack of articles 20 in the magazine 18. By reason of the suction imposed by the suction cups, they will grab and firmly hold the lowermost article so that upon moving the carrier arm away from the magazine, the lowermost article will be withdrawn therefrom. The manner of mounting the articles in the magazine and the use of retaining means therein such as blade member 80 and retainer pins 81 to insure that only the lowermost article is removed therefrom during each cycle of the operation of the apparatus is well-known. To return or deliver the thus removed article to the point of use, the cylinder unit 50 is operated by admitting air under pressure through branch 60 (FIG. 1) to cause a downward stroking of its piston and rod and hence downward travel of the actuator member 12. During an initial portion of the downward travel of the actuator member 12, the pinion gear 34 will be caused to rotate the carrier arm in a counter-clockwise direction, such movement of the carrier arm being effected against the bias force being applied to the rack 40 by cylinder unit 44 so that the rack will not move during this initial portion of downward travel of the actuator member from its second to first positions. However, upon the rotation of the carrier arm from the dashed line position to that shown in solid lines in FIG. 2, the carrier arm 30 will come into abutment with a stop member 82 extending laterally rearwardly from clevis 28 and since the carrier arm no longer can rotate, and since the pinion gear is in constant mesh with the rack such condition will result in the rack now being moved downwardly generally codirectionally with the actuator member and in opposition to the biasing force applied by cylinder unit to the rack and which is tending to elevate the rack. Since the cylinder unit 44 is always under a condition in which air pressure is constantly supplied thereto, during the downward movement of the piston therein, a relief valve or bypass chamber could be used to vent or accommodate the air forced therefrom by the downward movement of the piston. Upon the return of the carrier arm to the position shown in FIG. 2, the vacuum condition imposed on the suction cups is released and the article drops therefrom onto the cigarette packages.

The carrier arm is now in position for commencement of the next cycle of operation of the apparatus.

FIGS. 3 and 4 show features of the suction cups 32 employed with the apparatus which suction cups include a central disc member 100 which is provided at the article engaging face with intersecting grooves as at 102 and 104 and which grooves communicate with a central passage 106 by means of which the suction cups can be connected with a source of vacuum 110 via line 112, fitting 114, and passages formed in the carrier arm (not shown). The suction cups, it will be noted, include a lip extension 116 which desirably is made of a softer material than that of the disc members and which encircles the disc members. As will be noted particularly in FIG. 4, the disc members are recessed inwardly a distance from the end edge of the encircling lip structure 116 with the extent of the recess being determined by the rigidity of the article which is being transferred. In other words, the more rigid the article to be grabbed and held by the suction cup, the greater will be the recessing to allow a greater degree of flexure to insure proper and secure holding of same. On the other hand, if a more flexible and thinner member such as a sheet of paper is being transferred, the amount of recessing is minimized so that the article engaging face of the disc and the end edge of the lip structure could be in substantially planar alignment.

While there is above disclosed but one embodiment of the apparatus of the present invention, it is possible to produce still other embodiments without departing from the scope of the inventive concept herein disclosed, and accordingly it should be understood that all matter contained in the above description and the accompanying drawings should be interpreted as illustrative and not in a limiting sense.

What is claimed is:

1. Apparatus for transferring articles such as cards and the like from a storage location to a point of use at a second location remote from the first, said apparatus comprising an elongated actuator member supported for movement along a fixed vertical axis, a magazine for holding a plurality of the articles in a superposed stack thereof, said magazine being disposed at one side of said fixed axis, the point of use being disposed at the other side of said fixed axis and a distance below the magazine, means for reciprocating said actuator member along said fixed axis between first and second positions, a carrier arm rotatably mounted at one end of said actuator member, suction imposing means fixed to said carrier arm, and means operative when said actuator member is moved from its first to second positions for vertically elevating and concurrently rotating said carrier arm in one direction away from a positioning thereof at said point of use to position same at the other side of said fixed axis adjacent said magazine and with the suction imposing means engaged against the lowermost article in said stack thereby to effect suction withdrawal and holding of said lowermost article from the stack when said suction imposing means is moved away from said magazine, said carrier arm operating means being operative when said actuator member is moved from its second to first positions for concurrently rotating said carrier arm in an opposite direction and vertically lowering same to return said carrier arm to said point of use position, the said lowermost article being delivered to the point of use upon return of said carrier arm to said point of use and release of the suction imposed on said article, said carrier arm operating means comprising:

a pinion gear fixed to said carrier arm, a rack in constant mesh with said pinion gear, bias means associated with said rack tending to move said rack generally co-directionally with the movement of said actuator member when the latter is moved from its first to second positions whereby during an initial portion of the said movement of said actuator member there is concurrent generally co-directional movement of said actuator member and rack, bias limiting means operative during the remainder movement of said actuator member between its said first and second positions for preventing rack movement during said actuator member remainder movement whereby said pinion gear and carrier arm are caused to rotate in said one direction, said bias means in its bias stopped position being effective to prevent movement of said rack during an initial portion of the movement of said actuator member from its second to first position whereby said pinion gear and carrier arm are caused to rotate in said opposite direction, and stop means for limiting the rotation of said carrier arm in said arm opposite direction during the remainder portion of the movement of said actuator member between its second and first positions whereby during such remainder portion said rack is caused to move in tandem with said actuator member in opposition to said bias means.

2. The apparatus of claim 1 in which said means for reciprocating said actuator member is a double acting fluid operated cylinder unit, said actuator member being disposed in side-by-side relation with said cylinder unit, the cylinder unit including a piston and rod connected at one end to said piston, said rod being connected at its other end to said actuator member.

3. The apparatus of claim 2 in which said actuator member is received in a housing, said housing including guide means for maintaining the movement of said actuator member along said fixed vertical axis.

4. The apparatus of claim 2 in which said carrier arm rotation stop means comprises a stop member carried at the said one end of said actuator member and extending laterally therefrom at the point of use side of said fixed axis.

5. The apparatus of claim 1 in which said suction imposing means comprises suction cups fixed to said carrier arm.

6. The apparatus of claim 5 in which each of said suction cups includes a disc member having an article engaging surface, each such article engaging surface confronting the lowermost article in said stack when said carrier arm is adjacent said magazine, each such surface having intersecting grooves formed therein and communicating with a central passage formed in such disc member for connecting same with a source of vacuum.

7. The apparatus of claim 6 in which each of said suction cups further includes a lip structure encircling the disc member thereof, each such lip structure being of relatively softer material than the associated disc member.

8. The apparatus of claim 7, in which each of said disc member article engaging surfaces is recessed relative to the end edge surface of the associated lip structure.

9. Apparatus for transferring articles such as cards and the like from a storage location to a point of use at a second location remote from the first, said apparatus comprising an elongated actuator member supported for movement along a fixed vertical axis, a magazine for holding a plurality of the articles in a superposed stack thereof, said magazine being disposed at one side of said fixed axis, the point of use being disposed at the other side of said fixed axis and a distance below the magazine, means for reciprocating said actuator member along said fixed axis between first and second positions, a carrier arm rotatably mounted at one end of said actuator member, suction imposing means fixed to said carrier arm, and means operative when said actuator member is moved from its first to second positions for vertically elevating and concurrently rotating said carrier arm in one direction away from a positioning thereof at said point of use to position same at the other side of said fixed axis adjacent said magazine and with the suction imposing means engaged against the lowermost article in said stack thereby to effect suction withdrawal and holding of said lowermost article from the stack when said suction imposing means is moved away from said magazine, said carrier arm operating means being operative when said actuator member is moved from its second to first positions for concurrently rotating said carrier arm in an opposite direction and vertically lowering same to return said carrier arm to said point of use position, the said lowermost article being delivered to the point of use upon return of said carrier arm to said point of use and release of the suction imposed on said article, said carrier arm operating means comprising:

a pinion gear fixed to said carrier arm, a rack in constant mesh with said pinion gear, bias means associated with said rack tending to move said rack generally co-directionally with the movement of said actuator member when the latter is moved from its first to second positions whereby during an initial portion of the said movement of said actuator member there is concurrent generally co-directional movement of said actuator member and rack, bias limiting means operative during the remainder movement of said actuator member between its said first and second positions for preventing rack movement during said actuator member remainder movement whereby said pinion gear and carrier arm are caused to rotate in said one direction, said bias means in its bias stopped position being effective to prevent movement of said rack during an initial portion of the movement of said actuator member from its second to first position whereby said pinion gear and carrier arm are caused to rotate in said opposite direction, and stop means for limiting the rotation of said carrier arm in said opposite direction during the remainder portion of the movement of said actuator member between its second and first positions whereby during such remainder portion said rack is caused to move in tandem with said actuator member in opposition to said bias means, said means for reciprocating said actuator member being a double acting fluid operated cylinder unit, said actuator member being disposed in side-by-side relation with said cylinder unit, the cylinder unit including a piston and rod connected at one end to said piston, said rod being connected at its other end to said actuator member, said bias means comprising a single acting fluid operated cylinder including a piston and a rod connected at one end to said piston, the other end of said rod being connected to said rack, the piston stroke of said single acting cylinder being less than that of said double acting cylinder whereby said single acting cylinder piston operates as said bias limiting means.

* * * * *